US008024095B2

(12) United States Patent
Mintah et al.

(10) Patent No.: US 8,024,095 B2
(45) Date of Patent: Sep. 20, 2011

(54) ADAPTIVE WORK CYCLE CONTROL SYSTEM

(75) Inventors: Brian Mintah, Washington, IL (US); Robert J. Price, Dunlap, IL (US); Kevin D. King, Peoria, IL (US); Vijayakumar Janardhan, Washington, IL (US); Shoji Tozawa, Kobe (JP); Srinivas Kowta, Tamil Nadu (IN); Parmesh Venkateswaran, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 320 days.

(21) Appl. No.: 12/073,671

(22) Filed: Mar. 7, 2008

(65) Prior Publication Data

US 2009/0228177 A1 Sep. 10, 2009

(51) Int. Cl.
*G06F 7/70* (2006.01)

(52) U.S. Cl. ..... 701/50; 37/414; 342/357.31; 342/457

(58) Field of Classification Search ..... 701/35, 701/36, 50; 172/1, 2; 37/348
See application file for complete search history.

(56) References Cited

U.S. PATENT DOCUMENTS

| | | | |
|---|---|---|---|
| 4,035,621 | A | 7/1977 | Kemp |
| 4,805,086 | A | 2/1989 | Nielsen et al. |
| 4,945,221 | A | 7/1990 | Nielsen et al. |
| 4,995,468 | A | 2/1991 | Fukuda |
| 5,105,896 | A | 4/1992 | Kyrtsos |
| 5,220,968 | A | 6/1993 | Weber |
| 5,261,495 | A | 11/1993 | Szymczak |
| 5,268,834 | A | 12/1993 | Sanner et al. |
| 5,274,557 | A | 12/1993 | Moriya et al. |
| 5,357,424 | A | 10/1994 | Kakizaki et al. |
| 5,438,771 | A | 8/1995 | Sahm et al. |
| 5,446,980 | A | 9/1995 | Rocke |
| 5,493,798 | A | 2/1996 | Rocke et al. |
| 5,509,293 | A | 4/1996 | Karumanchi |
| 5,612,864 | A | 3/1997 | Henderson |
| 5,659,470 | A | 8/1997 | Goska et al. |
| 5,682,312 | A | 10/1997 | Rocke |
| 5,714,719 | A | 2/1998 | Otsuka et al. |
| 5,764,511 | A | 6/1998 | Henderson |
| 5,824,965 | A | 10/1998 | Fujii et al. |
| 5,880,408 | A | 3/1999 | Schreiner |
| 5,925,085 | A | 7/1999 | Kleimenhagen et al. |
| 5,953,838 | A | 9/1999 | Steenwyk |
| 5,955,706 | A | 9/1999 | Fonkalsrud et al. |
| 6,076,030 | A | 6/2000 | Rowe |
| 6,114,993 | A | 9/2000 | Henderson et al. |
| 6,211,471 | B1 | 4/2001 | Rocke et al. |
| 6,518,519 | B1 | 2/2003 | Crane, III et al. |
| 6,552,279 | B1 | 4/2003 | Lueschow et al. |
| 6,601,013 | B2 | 7/2003 | Lueschow et al. |
| 6,691,010 | B1 | 2/2004 | Gay |
| 6,845,311 | B1 | 1/2005 | Stratton et al. |
| 6,858,809 | B2 | 2/2005 | Bender |

(Continued)

*Primary Examiner* — Mark Hellner
*Assistant Examiner* — Redhwan Mawari
(74) *Attorney, Agent, or Firm* — Finnegan, Henderson, Farabow, Garrett & Dunner LLP

(57) ABSTRACT

A control system for an excavation machine is disclosed. The control system may have a work tool movable to perform an excavation work cycle, at least one sensor configured to monitor a speed of the work tool and generate a signal indicative of the monitored speed, and a controller in communication with the at least one sensor. The controller may be configured to record the monitored speed of the work tool during each excavation work cycle, and compare the signal currently being generated to a maximum speed recorded for a previous excavation work cycle. The controller may be further configured to partition a current excavation work cycle into a plurality of segments based on the comparison.

20 Claims, 3 Drawing Sheets

U.S. PATENT DOCUMENTS 6,934,616 B2 8/2005 Colburn et al.
7,003,386 B1 2/2006 Ericsson et al.
7,079,931 B2 7/2006 Sahm et al.
7,276,669 B2 10/2007 Dahl et al.
2005/0267713 A1 12/2005 Horkavi et al.
2006/0124323 A1 6/2006 Glover et al.
2007/0021895 A1 1/2007 Brandt et al.

ADAPTIVE WORK CYCLE CONTROL SYSTEM

TECHNICAL FIELD

The present disclosure relates generally to a control system, and more particularly, to an adaptive work cycle control system.

BACKGROUND

Excavation machines, for example hydraulic excavators, dragline excavators, wheel loaders, and front shovels operate according to well known cycles to excavate and load material onto a nearby haul vehicle. A typical cycle includes a dig segment, a swing-to-truck segment, a dump segment, and a swing-to-trench segment. During each of these segments, the excavation machine performs differently. For example, during a dig segment, high forces and high precision are required to push a tool into the material at an optimum attack angle, while during a swing-to-truck or swing-to-trench segment, high velocities and low precision are required. As such, the excavation machine is often controlled differently according to what segment of the cycle is currently being completed. In addition, the way that the machine is controlled during each segment can affect productivity of the machine, and the way in which productivity is measured and analyzed.

In order to facilitate productive control of an excavation machine and quality data gathering associated with performance tracking of the machine, it can be important to accurately detect and/or classify which segment of the excavation cycle is currently being performed (i.e., detect when one segment has started, which segment it is, and when it ends). In the past, an operator could manually note the segment and adjust control and/or data logging accordingly. However, as the machines become more complicated, it may be too interruptive for the operator to continue to perform this function. In addition, many of today's machines are remotely or autonomously controlled. Accordingly, a system for automatically recognizing and classifying the different segments of the excavation cycle is required.

One such system is disclosed in U.S. Pat. No. 6,114,993 (the '993 patent) issued to Henderson et al. on Sep. 5, 2000. The '993 patent discloses an excavator equipped with a positioning system. Based on inputs from the positioning system, loading and dumping operation's of the excavator's work cycle are determined. The loading and dumping operations may be detected by monitoring the angular velocity of the excavator's body. The angular velocity is determined by monitoring multiple position updates of the body as the body rotates. The angular velocity is then used to determine when and where the body has stopped, and the amount of time the body is stopped. If the body has stopped over an area that has not been mined, and is stopped for a predetermined amount of time, for example seven seconds or longer, the conclusion may be made that the excavator has loaded it's bucket. Similarly, if the body stopped over an area that has been mined, and is stopped for a predetermined amount of time, the conclusion may be made that the excavator has dumped its load. In this manner, the work cycle of the excavator may be segmented. In an alternative embodiment, the loading and dumping operations are determined using inputs from the positioning system, in conjunction with additional sensors such as a payload monitoring system.

Although the excavator of the '993 patent may utilize velocity and payload information to help segment a work cycle, it may be complicated and lack applicability. That is, the excavator requires knowledge about what has and hasn't yet been excavated, which can be difficult to attain and track. Without this information, it may not be possible to segment the work cycle. And, the excavator segments the work cycle only when the machine has stopped. It is not uncommon for an operator of the machine to never bring the machine to a complete stop during dumping. In these circumstances, the excavator of the '993 patent may be unable to fully segment the cycle.

The disclosed control system is directed to overcoming one or more of the problems set forth above.

SUMMARY

One aspect of the present disclosure is directed to a control system. The control system may include a work tool movable to perform an excavation work cycle, at least one sensor configured to monitor a speed of the work tool and generate a signal indicative of the monitored speed, and a controller in communication with the at least one sensor. The controller may be configured to record the monitored speed of the work tool during each excavation work cycle, and compare the signal currently being generated to a maximum speed recorded for a previous excavation work cycle. The controller may be further configured to partition a current excavation work cycle into a plurality of segments based on the comparison.

Another aspect of the present disclosure is directed to a method of partitioning an excavation work cycle into a plurality of segments. The method may include monitoring a speed of a work tool, and recording the monitored speed during each excavation work cycle. The method may further include comparing a current speed of the work tool to a maximum speed recorded for a previous excavation work cycle, and partitioning a current excavation work cycle into a plurality of segments based on the comparison.

DETAILED DESCRIPTION

Figure 1:
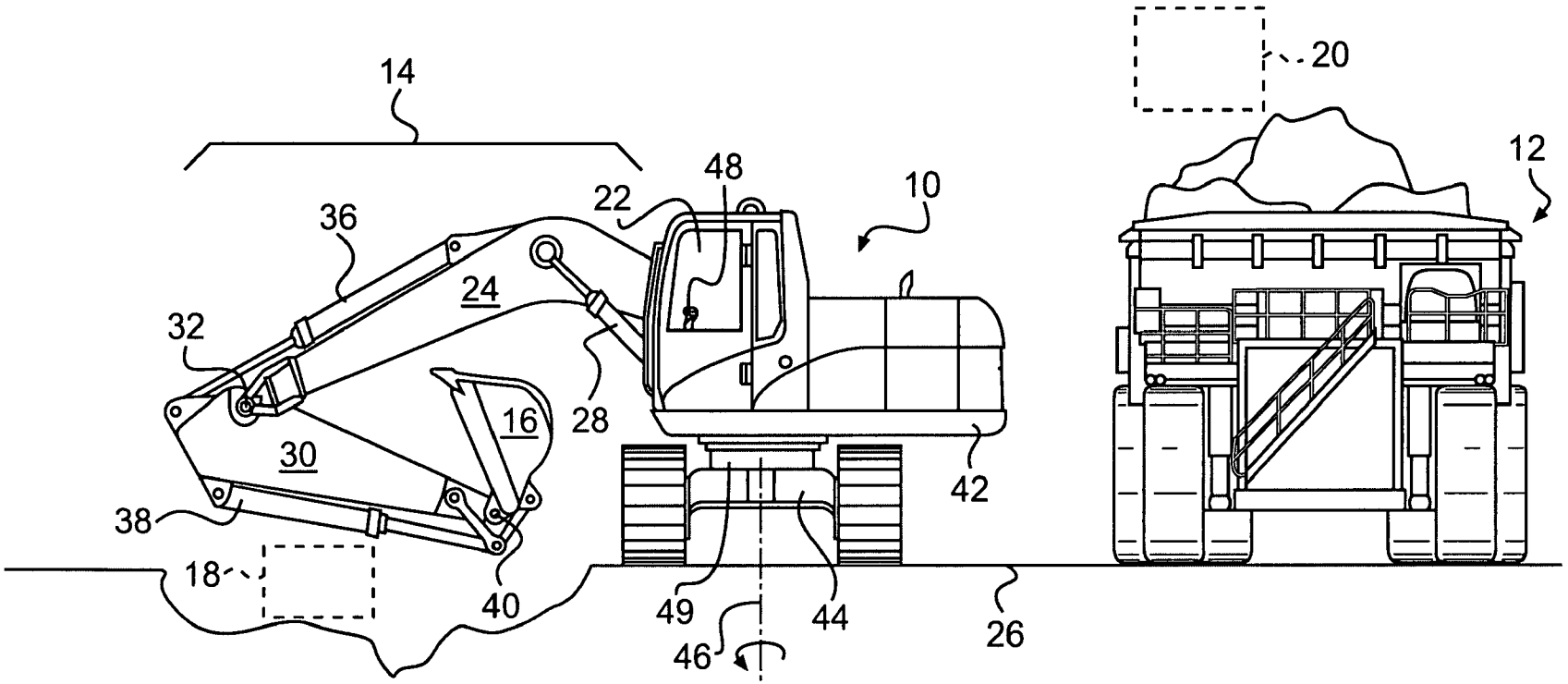
FIG. 1 is a diagrammatic illustration of an exemplary disclosed machine.

FIG. 1 illustrates an exemplary machine 10 having multiple systems and components that cooperate to excavate and load earthen material onto a nearby haul vehicle 12. In one example, machine 10 may embody a hydraulic excavator. It is contemplated, however, that machine 10 may embody another type of excavation machine such as a backhoe, a front shovel, a dragline excavator, or another similar machine. Machine 10 may include, among other things, an implement system 14 configured to move a work tool 16 between a dig location 18 within a trench and a dump location 20 over haul vehicle 12, and an operator station 22 for manual control of implement system 14.

Implement system 14 may include a linkage structure acted on by fluid actuators to move work tool 16. Specifically, implement system 14 may include a boom member 24 vertically pivotal relative to a work surface 26 by a pair of adjacent, double-acting, hydraulic cylinders 28 (only one shown in FIG. 1). Implement system 14 may also include a stick member 30 vertically pivotal about a horizontal axis 32 by a single, double-acting, hydraulic cylinder 36. Implement system 14 may further include a single, double-acting, hydraulic cylinder 38 operatively connected to work tool 16 to pivot work tool 16 vertically about a horizontal pivot axis 40. Boom member 24 may be pivotally connected to a frame 42 of machine 10. Frame 42 may be pivotally connected to an undercarriage member 44, and swung about a vertical axis 46 by a swing motor 49. Stick member 30 may pivotally connect boom member 24 to work tool 16 by way of pivot axes 32 and 40. It is contemplated that a greater or lesser number of fluid actuators may be included within implement system 14 and connected in a manner other than described above, if desired.

Numerous different work tools 16 may be attachable to a single machine 10 and controllable via operator station 22. Work tool 16 may include any device used to perform a particular task such as, for example, a bucket, a fork arrangement, a blade, a shovel, or any other task-performing device known in the art. Although connected in the embodiment of FIG. 1 to pivot relative to machine 10, work tool 16 may alternatively or additionally rotate, slide, swing, lift, or move in any other manner known in the art.

Operator station 22 may be configured to receive input from a machine operator indicative of a desired work tool movement. Specifically, operator station 22 may include one or more operator input devices 48 embodied as single or multi-axis joysticks located proximal an operator seat (not shown). Operator input devices 48 may be proportional-type controllers configured to position and/or orient work tool 16 by producing a work tool position signal that is indicative of a desired work tool speed and/or force in a particular direction. The position signal may be used to actuate any one or more of hydraulic cylinders 28, 36, 38 and/or swing motor 49. It is contemplated that different operator input devices may alternatively or additionally be included within operator station 22 such as, for example, wheels, knobs, push-pull devices, switches, pedals, and other operator input devices known in the art.

Figure 2:
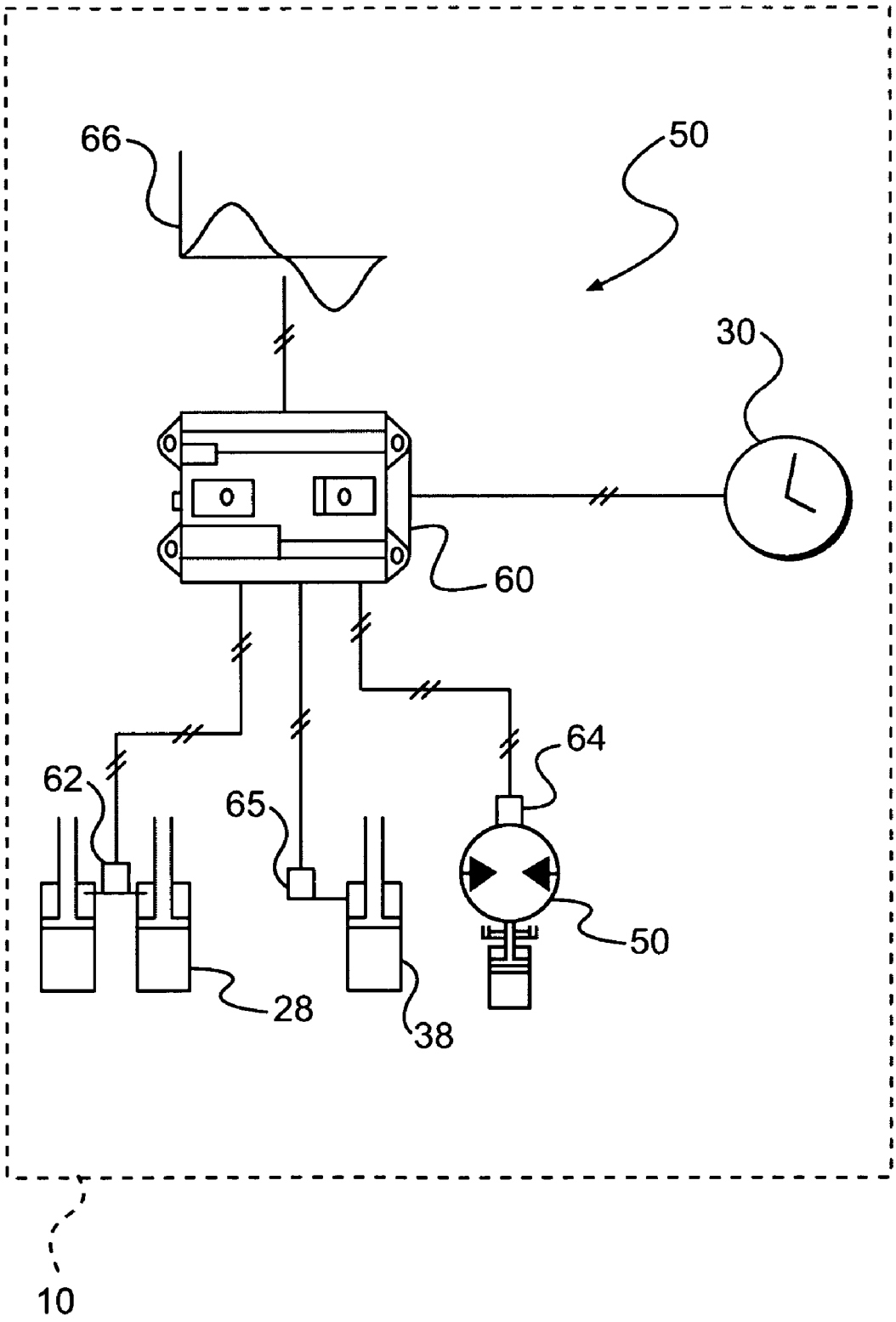
FIG. 2 is a schematic illustration of an exemplary disclosed control system that may be used with the machine of FIG. 1.

As illustrated in FIG. 2, machine 10 may include a control system 50 configured to monitor, record, and/or control movements of work tool 16 (referring to FIG. 1). In particular, hydraulic control system 50 may include a controller 60 in communication with a plurality of sensors. In one embodiment, controller 60 may be in communication with a first sensor 62, a second sensor 64, and a third sensor 65. Based on input received from these sensors 62, 64, 65, controller 60 may be configured to partition a typical work cycle performed by machine 10 into a plurality of segments, for example, into a dig segment, a swing-to-truck segment (i.e., a first swing segment), a dump segment, and a swing-to-trench segment (i.e., a second swing segment), as will be described in more detail below.

Controller 60 may embody a single microprocessor or multiple microprocessors that include a means for performing an operation of control system 50. Numerous commercially available microprocessors can be configured to perform the functions of controller 60. It should be appreciated that controller 60 could readily be embodied in a general machine microprocessor capable of controlling numerous machine functions. Controller 60 may include a memory, a secondary storage device, a processor, and any other components for running an application. Various other circuits may be associated with controller 60 such as power supply circuitry, signal conditioning circuitry, solenoid driver circuitry, and other types of circuitry.

One or more maps 66 relating signals from sensors 62 and 64 to the different segments of the typical excavation work cycle may be stored within the memory of controller 60. Each of these maps may include a collection of data in the form of tables, graphs, and/or equations. In one example, threshold speeds associated with the start and/or end of one or more of the segments may be stored within the maps. In another example, threshold forces associated with the start and/or end of one or more of the segments may be stored within the maps. In yet another example, a speed and/or a force of work tool 16 may be recorded into the maps and subsequently analyzed by controller 60 during partitioning of the excavation work cycle. Controller 60 may be configured to allow the operator of machine 10 to directly modify these maps and/or to select specific maps from available relationship maps stored in the memory of controller 60 to affect cycle partitioning. It is contemplated that the maps may additionally or alternatively be automatically selectable based on modes of machine operation, if desired.

First sensor 62 may be associated with the generally horizontal swinging motion of work tool 16 imparted by swing motor 50 (i.e., the motion of frame 42 relative to undercarriage member 44). Specifically, first sensor 62 may be a rotational position or speed sensor associated with the operation of swing motor 49, an angular position or speed sensor associated with the pivot connection between frame 42 and undercarriage member 44, a local or global coordinate position or speed sensor associated with any linkage member connecting work tool 16 to undercarriage member 44 or with work tool 16 itself, a displacement sensor associated with movement of operator input device 48, or any other type of sensor known in the art that may generate a signal indicative of a swing position or speed of machine 10. This signal may be sent to and recorded by controller 60 during each excavation cycle. It is contemplated that controller 60 may derive a swing speed based on a position signal from first sensor 62 and an elapsed period of time, if desired.

Second sensor 64 may be associated with the vertical pivoting motion of work tool 16 imparted by hydraulic cylinders 28 (i.e., associated with the lifting and lowering motions of boom member 24 relative to frame 42). Specifically, second sensor 64 may be an angular position or speed sensor associated with a pivot joint between boom member 24 and frame 42, a displacement sensor associated with hydraulic cylinders 28, a local or global coordinate position or speed sensor associated with any linkage member connecting work tool 16 to frame 42 or with work tool 16 itself, a displacement sensor associated with movement of operator input device 48, or any other type of sensor known in the art that may generate a signal indicative of a pivoting position or speed of machine 10. This signal may be sent to controller 60 during each excavation cycle. It is contemplated that controller 60 may derive a pivot speed based on a position signal from second sensor 64 and an elapsed period of time, if desired.

Third sensor 65 may be associated with the pivoting force of work tool 16 imparted by hydraulic cylinder 38. Specifically, third sensor 65 may be a pressure sensor associated with one or more chambers within hydraulic cylinder 38 or any other type of sensor known in the art that may generate a signal indicative of a pivoting force of machine 10 generated during a dig and dump operation of work tool 16. This signal may be sent to controller 60 during each excavation cycle.

Figure 3:
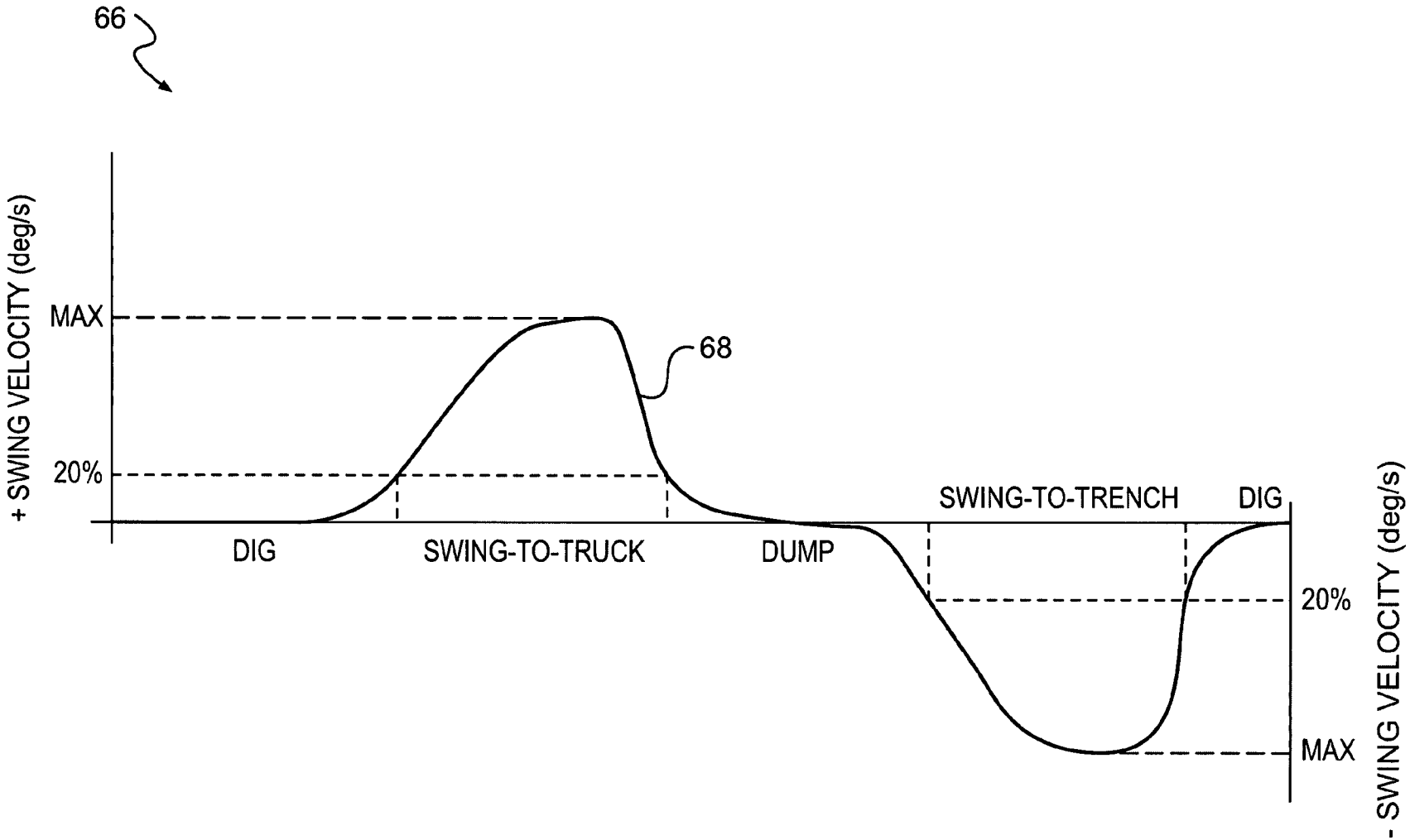
FIG. 3 is an exemplary disclosed control map that may be used by the control system of FIG. 2.

With reference to FIG. 3, a curve 68 may represent the swinging speed of machine 10 throughout each segment of the excavation work cycle, as recorded by controller 60 based on signals received from sensor 64. During most of the dig segment, the swing speed may typically be about zero (i.e., machine 10 may generally not swing during a digging operation). At completion of a dig stroke, machine 10 may generally be controlled to swing work tool 16 toward the waiting haul vehicle 12 (referring to FIG. 1). As such, the swing speed of machine 10 may begin to increase toward the end of the dig segment. As the swing-to-truck segment of the excavation work cycle progresses, the swing speed may reach a maximum when work tool 16 is about midway between dig location 18 and dump location 20, and then slow toward the end of the swing-to-truck segment. During most of the dump segment, the swing speed may typically be about zero (i.e., machine 10 may generally not swing during a dumping operation). When dumping is complete, machine 10 may generally be controlled to swing work tool 16 back toward dig location 18 (referring to FIG. 1). As such, the swing speed of machine 10 may increase toward the end of the dump segment. As the swing-to-trench segment of the excavation cycle progresses, the swing speed may reach a maximum in a direction opposite to the swing direction during the swing-to-truck segment of the excavation cycle. This maximum speed may generally be achieved when work tool 16 is about midway between dump location 20 and dig location 18. The swing speed of work tool 16 may then slow toward the end of the swing-to-trench segment, as work tool 16 nears dig location 18.

Controller 60 may partition a current excavation work cycle into the four segments described above based on signals received from sensors 62, 64, 65, and with reference to the swing speeds and pivot forces of machine 10 recorded for a previous excavation work cycle (i.e., with reference to curve 68 within map 66). Typically, controller 60 may partition the excavation work cycle based on at least three different conditions being satisfied, one condition associated with the swing motion measured by sensor 62, one condition associated with the pivoting motion measured by sensor 64, and one condition associated with the pivot force measured by sensor 65. For example, controller 60 may partition the current excavation work cycle between the dig segment and the swing-to-truck segment when a current swing speed of machine 10 exceeds an amount of the maximum swing speed recorded during the previous swing-to-truck segment, when the pivot speed exceeds a threshold speed value, and when the pivot force is less than a threshold value. In one example, the amount may be about 20% of the maximum swing speed recorded during the previous swing-to-truck segment, while the threshold speed value may be about 5°/sec. The threshold pivot force may vary based on a size of machine 10 and an application thereof. It is also contemplated that the threshold pivot force, similar to the swing speed, may be based on the maximum force generated during a previously recorded cycle, if desired.

The excavation work cycle may be partitioned between the swing-to-truck segment and the dump segment in a manner similar to that described above. In particular, controller 60 may partition the current excavation work cycle between the swing-to-truck segment and the dump segment when a current swing speed of machine 10 slows to less than about 20% of the maximum swing speed recorded during the previous swing-to-truck segment, when the pivot speed slows to less than about 5°/sec, and when the pivot force exceeds a threshold value.

In contrast to the dig and swing-to-truck segments, the dump segment may be considered complete based on a current swing speed, a current pivot direction, and a pivot force, regardless of pivot speed. That is, controller 60 may partition the excavation work cycle between the dump segment and the swing-to-trench segment when a current swing speed of machine 10 exceeds about 20% of the maximum swing speed recorded during the previous swing-to-trench segment, when the pivot direction is toward dig location 18 (i.e., in a direction opposite from the pivot direction during the swing-to-truck segment or in the same direction as the pull of gravity), and when the pivot force is less than a threshold value. It should be noted that, although shown as a negative speed by curve 68, this negative aspect of the swing speed is simply intended to indicate a direction of the swing speed in opposition to the swing direction encountered during the swing-to-truck segment. In some situations, the maximum swing speeds of the swing-to-truck and swing-to-trench segments may have substantially the same magnitude.

Controller 60 may partition the swing-to-trench segment from the dig segment when a current swing speed of machine 10 slows to less than about 20% of the maximum swing speed recorded during the previous swing-to-trench segment, when the pivot speed is less than about 5°/sec, and when the pivot force is greater than a threshold amount. After this partition has been made, controller 60 may repeat the process with the next excavation work cycle.

In some situations, it may be beneficial to index each excavation work cycle and/or each segment of each excavation work cycle to an elapsed period of time or a particular time of the occurrence. In these situations, control system 50 may include a timer 70 in communication with controller 60. Controller 60 may be configured to receive signals from timer 70, and record performance information associated therewith. For example, controller 60 may be configured to record a total number of cycles completed within a user defined period of time, a time required to complete each cycle, a number of segments completed during the user defined period of time, a time to complete each segment, an occurrence time of each cycle, an occurrence time of each segment of each cycle, etc. Each work cycle may be considered completed after the occurrence and detection of each dump segment. This information may be utilized to determine a productivity and/or efficiency of machine 10.

INDUSTRIAL APPLICABILITY

The disclosed control system may be applicable to any excavation machine that performs a substantially repetitive work cycle. The disclosed control system may promote machine control and performance data analysis by partitioning the work cycle into discrete segments according to speeds of the excavation machine.

Several benefits may be associated with the disclosed control system. First, because controller 60 may partition the excavation work cycle according to speeds and forces, variability in the excavation process may be accounted for. And, because controller 60 may adapt its partitioning parameters based on changing control over machine 10 (i.e., vary the swing speed threshold values based on the speeds recorded during a previous excavation work cycle), the accuracy of the partitioning may be maintained. Further, the disclosed control system may be equally applicable to manned and unmanned machines.

It will be apparent to those skilled in the art that various modifications and variations can be made to the disclosed control system. Other embodiments will be apparent to those skilled in the art from consideration of the specification and practice of the disclosed control system. It is intended that the specification and examples be considered as exemplary only, with a true scope being indicated by the following claims and their equivalents.

What is claimed is:

1. A control system, comprising:

a work tool movable to perform an excavation work cycle including multiple work cycle segments;

a plurality of sensors operatively coupled to the work tool, the plurality of sensors including:

a first sensor configured to monitor a first speed of the work tool;

a second sensor configured to monitor a second speed of the work tool, the second speed being different from the first speed;

a third sensor configured to monitor a force of the work tool; and a controller in communication with the at least first sensor, second sensor, and third sensor and configured to:

record the monitored first speed, second speed, and force of the work tool during each excavation work cycle;

compare a current first speed to a maximum first speed recorded for a previous excavation work cycle;

compare a current second speed to a threshold speed value;

compare a current force to a threshold force value; and identify a current work cycle segment based at least in part on at least two of (i) the comparison of the first speed, (ii) the comparison of the second speed, and (iii) the comparison of the force.

2. The control system of claim 1, wherein the multiple work cycle segments include a dig segment, a first swing segment, a dump segment, and a second swing segment.

3. The control system of claim 2, wherein:

the first speed is a swing speed of the work tool;

the second speed is a pivot speed of the work tool; and the controller is configured to identify the current work cycle segment as the first swing segment when (i) a current swing speed in a first direction exceeds a predetermined amount of a maximum swing speed in the first direction achieved during the previous excavation work cycle, (ii) a current pivot speed in a second direction exceeds a threshold speed value, and (iii) a current force of the work tool is below a threshold force.

4. The control system of claim 3, wherein:

the predetermined amount is about 20% of the maximum swing speed achieved during the previous excavation work cycle; and the threshold speed value is about 5°/sec.

5. The control system of claim 3, wherein the controller is configured to identify the current work cycle segment as the dump segment when (i) the current swing speed in the first direction is below a predetermined amount of the maximum swing speed in the first direction achieved during the previous excavation work cycle, (ii) the current pivot speed in the second direction is below a threshold speed value, and (iii) the current force of the work tool exceeds a threshold force.

6. The control system of claim 3, wherein the controller is configured to identify the current work cycle segment as the second swing segment when (i) the current swing speed in a third direction opposite the first direction exceeds a predetermined amount of a maximum swing speed in the third direction achieved during the previous excavation work cycle, (ii) a direction of the current pivot speed is in a fourth direction opposite the second direction, and (iii) the current force of the work tool is below a threshold force.

7. The control system of claim 3, wherein the controller is configured to identify the current work cycle segment as the dig segment when (i) the current swing speed of the work tool in a third direction opposite the first direction is below a predetermined amount of a maximum swing speed in the third direction achieved during the previous excavation work cycle, and (ii) the current force of the work tool exceeds a threshold force.

8. The control system of claim 1, further including:

a linkage member operatively connected to the work tool;

a first actuator configured to swing the work tool in a first direction;

a second actuator configured to pivot the work tool in a second direction;

a third actuator configured to pivot the work tool relative to the linkage member; and at least one operator input device configured to generate a signal indicative of an operator desired movement of at least one of the first, second, and third actuators.

9. The control system of claim 1, further including a timer, wherein the controller is in communication with the timer and configured to relate a complete excavation work cycle and each of the plurality of segments to an elapsed period of time.

10. A method of identifying a current work cycle segment of a work tool operating in an excavation work cycle including multiple work cycle segments, the method comprising:

monitoring a first speed of a work tool;

monitoring a second speed of the work tool, the second speed being different from the first speed;

monitoring a force of the work tool;

recording the monitored first speed, second speed, and force during each excavation work cycle;

comparing a current first speed of the work tool to a maximum first speed recorded for a previous excavation work cycle;

comparing a current second speed of the work tool to a threshold speed value;

comparing a current force of the work tool to a threshold force value; and identifying a current work cycle segment of the work tool based at least in part on at least two of (i) the comparison of the current first speed, (ii) the comparison of the current second speed, and (iii) the comparison of the force.

11. The method of claim 10, wherein the multiple work cycle segments include a dig segment, a first swing segment, a dump segment, and a second swing segment.

12. A machine, comprising:

a frame;

a boom member connected to swing and pivot relative to the frame;

a work tool operatively connected to the boom member and adapted to operate in an excavation work cycle including multiple work cycle segments, the multiple work cycle segments including at least a dig segment, a first swing segment, a dump segment and a second swing segment;

a first sensor configured to monitor a swing speed of the boom member and generate a first signal indicative of the monitored swing speed;

a second sensor configured to monitor a pivot speed of the boom member and generate a second signal indicative of the monitored pivot speed;

a third sensor configured to monitor a force of the work tool and generate a third signal indicative of the monitored pivot speed; and a controller in communication with the first, second, and third sensors and being configured to:

record the monitored swing speed, pivot speed, and force of the work tool during each excavation work cycle;

compare a current swing speed to a maximum swing speed recorded for a previous excavation work cycle;

compare a current pivot speed to a threshold speed value;

compare a current force to a threshold force value ; and identify a current work cycle segment based at least in part on at least two of (i) the comparison of the current swing speed, (ii) the comparison of the current pivot speed, and (iii) the comparison of the current force, the current work cycle segment being one of the dig segment, the first swing segment, the dump segment and the second swing segment.

13. The machine of claim 12, wherein the controller is configured to identify the current work cycle segment as the first swing segment when the current swing speed in a first direction exceeds a predetermined amount of a maximum swing speed in the first direction achieved during the previous excavation work cycle, the current pivot speed in a second direction exceeds a threshold speed value, and the current force is below a threshold force.

14. The machine of claim 13, wherein:

the predetermined amount is about 20% of the maximum swing speed achieved during the previous excavation work cycle; and the threshold speed value is about 5°/sec.

15. The machine of claim 13, wherein the controller is configured to identify the current work cycle segment as the dump segment when (i) the current swing speed in the first direction is below a predetermined amount of the maximum swing speed in the first direction achieved during the previous excavation work cycle, (ii) the current pivot speed in the second direction is below a threshold speed value, and (iii) the current force of the work tool exceeds a threshold force.

16. The machine of claim 15, wherein the controller is configured to identify the current work cycle segment as the second swing segment when (i) the current swing speed in a third direction opposite the first direction exceeds a predetermined amount of a maximum swing speed in the third direction achieved during the previous excavation work cycle, (ii) a direction of the current pivot speed is in a fourth direction opposite the second direction, and (iii) the current force of the work tool is below a threshold force.

17. The machine of claim 15, wherein the controller is configured to identify the current work cycle segment as the dig segment when (i) the current swing speed in a third direction opposite the first direction is below a predetermined amount of a maximum swing speed in the third direction achieved during the previous excavation work cycle, and (ii) the current force of the work tool exceeds a threshold force.

18. The method of claim 11, wherein identifying a current work cycle segment includes identifying the current work cycle segment as the first swing segment when (i) the current swing speed in a first direction exceeds a predetermined amount of a maximum swing speed in the first direction achieved during the previous excavation work cycle, (ii) the current pivot speed in a second direction exceeds a threshold speed value, and (iii) the current force is below a threshold force.

19. The method of claim 18, wherein the predetermined amount is about 20% and the threshold speed value is about 5°/sec.

20. The method of claim 11, wherein identifying a current work cycle segment includes identifying the current work cycle segment as the dump segment when (i) the current swing speed in a first direction is below a predetermined amount of the maximum swing speed in the first direction achieved during the previous excavation work cycle, (ii) the current pivot speed in the second direction is below a threshold speed value, and (iii) the current force of the work tool exceeds a threshold force.

* * * * *